US007701427B2

(12) United States Patent
Yamagishi

(10) Patent No.: US 7,701,427 B2
(45) Date of Patent: Apr. 20, 2010

(54) DISPLAY PANEL MODULE, DISPLAY UNIT, INSPECTION DEVICE FOR DISPLAY PANEL AND INSPECTION METHOD FOR DISPLAY PANEL

(75) Inventor: Eiichi Yamagishi, Shiojiri (JP)

(73) Assignee: Seiko Epson Corporation (JP)

( * ) Notice: Subject to any disclaimer, the term of this patent is extended or adjusted under 35 U.S.C. 154(b) by 896 days.

(21) Appl. No.: 11/449,795

(22) Filed: Jun. 8, 2006

(65) Prior Publication Data

US 2006/0280356 A1 Dec. 14, 2006

(30) Foreign Application Priority Data

Jun. 10, 2005 (JP) ..... 2005-171516

(51) Int. Cl.
*G09G 3/36* (2006.01)

(52) U.S. Cl. ..... 345/87; 349/192; 324/770; 348/180

(58) Field of Classification Search ..... 345/87–102; 348/175–194; 349/192; 324/770
See application file for complete search history.

(56) References Cited

U.S. PATENT DOCUMENTS 5,751,261 A * 5/1998 Zavracky et al. ..... 345/55
2006/0152468 A1* 7/2006 Ozaki ..... 345/102

FOREIGN PATENT DOCUMENTS

| | | |
|---|---|---|
| JP | 03-146993 | 6/1991 |
| JP | 06-236162 | 8/1994 |
| JP | 07-199138 | 8/1995 |
| JP | 08-202320 | 8/1996 |
| JP | 11-119684 | 4/1999 |
| JP | 2000-206001 | 7/2000 |
| JP | 2002-267571 | 9/2002 |
| WO | WO 2004090856 A1 * | 10/2004 |

* cited by examiner

*Primary Examiner*—Sumati Lefkowitz
*Assistant Examiner*—Seokyun Moon
(74) *Attorney, Agent, or Firm*—Harness, Dickey & Pierce, P.L.C.

(57) ABSTRACT

A display panel module, includes: a display panel having a light-transmitting section that can control a transmissive light amount; an illuminating device that can irradiate a light to the display panel; an illumination controller for controlling the drive of the illuminating device; a display panel controller for controlling the drive of the display panel; and a display mode controller that can control a normal display mode for displaying an image in accordance with image signals input from the outside and an inspection mode for inspecting the display panel. When the inspection mode is selected in the display mode controller, the display panel controller controls the drive of the display panel depending on inspection purposes. The illumination controller controls at least one of brightness, lighting timing and illumination color of the illuminating device depending on the inspection purposes.

1 Claim, 7 Drawing Sheets

DISPLAY PANEL MODULE, DISPLAY UNIT, INSPECTION DEVICE FOR DISPLAY PANEL AND INSPECTION METHOD FOR DISPLAY PANEL

The entire disclosure of Japanese Patent Application No. 2005-171516, filed Jun. 10, 2005, is expressly incorporated by reference herein.

BACKGROUND

1. Technical Field

The present invention relates to a display panel module incorporating a display panel and an illuminating device, a display unit incorporating the display panel module, an inspection device for the display panel and an inspection method for the display panel.

2. Related Art

On manufacturing lines for liquid crystal display panels such as TFT panels, various inspections are conducted for each liquid crystal display panel to detect a defect. In an ordinary inspection, an illuminating device has been used to irradiate a light to an object to be inspected, and a checker visually observes a front surface of the object to mainly inspect for particle residues on the liquid crystal display panel or breaks in electrode wiring (see, for example, JP-A-2000-206001).

However, since the inspection disclosed in the publication is arranged such that the illuminating device irradiates a light to the front surface of the liquid crystal display panel and the checker inspects for defects using the reflection light, the inspection can be capable of detecting defects such as particle residues and breaks in electrode wiring but is incapable of detecting defects such as luminescent spots, which may occur when an image is displayed on the liquid crystal display panel by a transmissive illumination irradiated by a backlight.

Hence, the defects such as luminescent spots have been inspected typically by driving the liquid crystal display panel with the backlight or an inspection illumination kept on. In such a luminescent spot defect inspection, light-transmitting sections (dots) of the liquid crystal display panel are shielded to display the entire black screen so as to detect a luminescent spot defect through a judgment in a visual observation by the checker or by using CCD cameras.

However, the backlight or the inspection illumination is not controlled depending on inspection purposes but merely keeps irradiating a white light of typical luminance, so that the ordinary inspections have difficulty in detecting some types of defects, thus decreasing defect detection accuracy.

SUMMARY

In light of such existing circumstances described above, an object of the invention is to provide a display panel module, a display unit, an inspection device for the display panel and an inspection method for the display panel that can detect various defects at high accuracy.

As an advantage of some aspects of the invention, a display panel module includes: a display panel having a light-transmitting section that can control a transmissive light amount; an illuminating device that can irradiate a light to the display panel; an illumination controller for controlling the drive of the illuminating device; a display panel controller for controlling the drive of the display panel; and a display mode controller that can control a normal display mode for displaying an image in accordance with image signals input from the outside and an inspection mode for inspecting the display panel. When the inspection mode is selected in the display mode controller, the display panel controller controls the drive of the display panel depending on inspection purposes. The illumination controller controls at least one of brightness, lighting timing and illumination color of the illuminating device depending on the inspection purposes.

The display panel module of the aspect of the invention controls at least one of the brightness, lighting timing and illumination color of the illuminating device in accordance with inspection purposes in the defect inspection of the display panel, thereby making a defect distinguishable, if any, to be detected at enhanced defect detection accuracy.

Note that, controlling the brightness of the illuminating device means automatically adjusting the luminance of the illuminating device in accordance with inspection purposes. Controlling the lighting timing of the illuminating device means adjusting a lighting period of time, a lighting interval or the like of the illuminating device such as how long the illuminating device is kept on or at what interval the illuminating device is switched on and off. Controlling the illumination color of the illuminating device means selecting the illumination color when the illuminating device is capable of producing an illumination color other than white lights. Accordingly, when the illuminating device is capable of irradiating only white lights, the illumination controller only controls the brightness or the lighting timing thereof.

As another advantage of some aspects of the invention, with the display panel module, a luminescent spot may be preferably inspected, when the inspection mode is selected in the display mode controller. When the luminescent spot is inspected, the display panel controller may preferably display a black screen by shielding the light-transmitting section of the display panel. The illumination controller may preferably control the brightness of the illuminating device to be higher than a standard setting value.

Herein, the standard setting values are values of standard that are set for various defect inspections so as to be lower than a maximum luminance that the illuminating device can irradiate when it is not necessary to control the brightness of the illuminating device.

The display panel module of the aspect of the invention controls the display panel and the illuminating device in accordance with inspection purposes, so that a luminescent spot defect hard to distinguish of the display panel can be more easily detected. The luminescent spot defect can be detected by judging whether there is a luminescent spot or not, when the light-transmitting section, i.e. the dot to be turned on, of the display panel is set to have a light transmission amount of zero (to be turned off) to display the panel in black.

Herein, an area of the luminescent spot is minute as compared with the light-transmitting section (dot). Hence, when the brightness (luminance) of the illuminating device is set to a standard setting value, the luminance of the luminescent spot defect becomes low, thereby making the detection of the luminescent spot defect difficult either in visual inspections by the checker or in inspections using machines such as cameras or image processors.

In contrast, according to the aspect of the invention, when dots are turned off for the luminescent spot defect inspection, the brightness of the illuminating device is set brighter than standard setting values used in other types of inspections, thereby increasing the luminance of the luminescent spot defect portion. Hence, the luminescent spot defect can be detected easily and at high accuracy in both visual and machine inspections.

It is only necessary to set the brightness of the illuminating device higher than the standard setting values in the luminescent spot defect inspection. However, it is preferable to set the brightness to a maximum value that the illuminating device can output, since such arrangement improves the luminance of the luminescent spot defect portion, thereby facilitating the detection of the luminescent spot defect.

As another advantage of some aspects of the invention, with the display panel module, a leakage may be preferably inspected when the inspection mode is selected in the display mode controller. When the leakage is inspected, the display panel controller may preferably input a display frame signal of an alternating current signal to the display panel in order to place the light-transmitting section of the display panel in a light transmittable state in which the light can be transmitted. The illumination controller may preferably control the lighting timing of the illuminating device such that the illuminating device is turned on at a time point just before the display frame signal is switched to a reverse polarity and is kept being lit for a shorter period of time than half of a cycle of the display frame signal.

The display panel module of the aspect of the invention controls the display panel and the illuminating device in accordance with inspection purposes, so that a leakage defect of the display panel can be more easily detected. Specifically, the leakage defect can be detected by judging whether or not there is a dot which luminescence gradually decreases, when the light-transmitting section, i.e. the dot to be turned on, of the display panel is set to have a maximum light transmission amount to display the panel in white.

Herein, at a time point when the polarity of the display frame signal is switched over, each dot is charged with a voltage to restore to a predetermined voltage, thereby also increasing the transmissive light amount of the dot to a predetermined amount. Accordingly, when the illuminating device is kept on, the luminance of the dot with a leakage defect becomes highest at a time point when the polarity of the display frame signal is switched over and then gradually decreases. When the polarity is reversely switched over next time, the luminance becomes high again, repeating this increase and decrease in luminance in such a timing.

Herein, since the display frame signal is about 30 Hz for example, it is not possible for the checker of the visual inspection to recognize a change in luminance due to the leakage defect. The dot with the leakage defect will be considered as if to keep lighting at an average brightness within allowable luminance changes because such dot only has a small difference in brightness from the normal portion, thereby making it difficult to detect the leakage defect.

In contrast, according to the aspect of the invention, in which the display timing of the illuminating device is controlled such that the illuminating device is on, e.g., for a short period of time just before the polarity is switched over, the dot with the leakage defect is turned on when the transmissivity thereof is decreased and the luminance of the dot becomes extremely low, making a large difference in brightness from the normal portion. Thereby, the leakage defect can be detected at high accuracy even in the visual inspection by the checker.

Note that, since the display panel module such as liquid crystal display panels usually has a display frame signal cycle of 10 to 16 ms, the decrease in luminescence may not be distinguishable when the illuminating device is turned on even if there is a leakage defect, because the cycle is such a relatively short time and the dot with the defect is charged before the luminescence is decreased enough. Hence, in order to control the display timing of the illuminating device for the leakage defect inspection, it is preferable to set the display frame signal to have a longer cycle than the normal display frame signal, e.g., to be more than twice of the normal display frame signal cycle such that the checker can easily recognize the decrease in luminescence when the illuminating device is on, thereby detecting the leakage defect.

The display frame cycle may be appropriately set, for example, to 20 to 150 ms.

As another advantage of some aspects of the invention, with the display panel module, the illuminating device may be preferably provided at least with a red illuminating device, a green illuminating device and a blue illuminating device and may be preferably capable of turning on each of the illuminating devices individually. The display panel may be preferably provided with: color filters respectively of red, green and blue; and light-transmitting sections that can control respective transmissive light amounts of the color filters. A single color display of blue or red may be preferably inspected, when the inspection mode is selected in the display mode controller. The display panel controller may preferably control the display panel such that only the light-transmitting section corresponding to the blue color filter is set light-transmissive and the remaining light-transmitting sections are light-shielded when the single color display of blue is inspected. At the same time, the display panel controller may preferably control the display panel such that only the light-transmitting section corresponding to the red color filter is set light-transmissive and the remaining light-transmitting sections are light-shielded when the single color display of red is inspected. The illumination controller may preferably turn only the blue illuminating device on when the single color display of blue is inspected, and turn only the red illuminating device on when the single color display of red is inspected.

The display panel module of the aspect of the invention controls the display panel and the illuminating device in accordance with inspection purposes, so that a color defect of the display panel can be more easily detected. Specifically, in case of liquid crystal display panels capable of color-displaying in R, G and B (red, green and blue), an inspection for color defect is conducted by controlling the drive of the liquid crystal display panel with an inspection illumination of white color or a backlight turned on to display in each of the colors, red, green and blue. Note that, human eyes are sensitive to green color and less sensitive to blue and red as compared with green. Hence, when a light is leaked from a green portion of the color filter, such green leaked light can have effects on eyes, resulting in an oversight of a blue defect or a red defect.

In contrast, according to the exemplary embodiment, in which the illumination lights by the illuminating device are set so as to correspond to the colors of the to-be-inspected dots of blue or red, the green leaked lights can be prevented from being generating, thereby enhancing the defect detection accuracy in the inspection by the checker.

On the other hand, a leaked light of blue or red, if any, has little effects on the inspection for green color, so that the illuminating device may be controlled to output white illumination lights or to output green lights that have the same color as the to-be-inspected dots.

A display unit of an aspect of the invention is provided with the above described display panel modules.

With the display unit incorporating the display panel module, it is possible to inspect the panel incorporated in the display unit. Hence, even if a defect of the display panel is generated in a process of incorporating the module in the unit after the manufacturing of the display panel module, such defects of the panel can be easily detected.

As another advantage of some aspects of the invention, an inspection device for a display panel is for inspecting the display panel having a light-transmitting section that can control a transmissive light amount. The inspection device includes: an illuminating device that can irradiate a light to the display panel; an illumination controller for controlling the drive of the illuminating device; a display panel controller for controlling the drive of the display panel; and a display mode controller that can control a normal display mode for displaying an image in accordance with image signals input from the outside and an inspection mode for inspecting the display panel. When the inspection mode is selected in the display mode controller, the display panel controller controls the drive of the display panel depending on inspection purposes. The illumination controller controls at least one of brightness, lighting timing and illumination color of the illuminating device depending on the inspection purposes.

With the inspection device for display panels, the display panel and the illuminating device may be controlled in the luminescent spot inspection, the leakage inspection or the single color display inspection in the same manner as the display panel module.

With this inspection device, the luminescent spot defects, leakage defects and color defects of the display panel can be detected at high accuracy by controlling the brightness, lighting timing and illumination color of the illuminating device depending on inspection purposes.

As an advantage of some aspects of the invention, an inspection method for a display panel of an aspect of the invention is for inspecting a display panel having a light-transmitting section that can control a transmissive light amount. The inspection method includes: a display panel controlling process for controlling the drive of the display panel depending on inspection purposes; and an illumination controlling process for controlling at least one of brightness, lighting timing and illumination color of the illuminating device that irradiates a light to the display panel depending on the inspection purposes.

When the luminescent spot inspection is conducted, it is only necessary to control in the display panel controlling process such that the screen is displayed in black by shielding the light-transmitting sections of the display panel, and to control in the illumination controlling process such that the brightness of the illuminating device is brighter than the standard setting values.

When the leakage inspection is conducted, in the display panel controlling process, the display panel is input with a display frame signal of an alternating current signal to control the light-transmitting section of the display panel into a light transmittable state in which a light can be transmitted, and, in the illumination controlling process, the lighting timing of the illuminating device is controlled such that the illuminating device is turned on at a time point just before the display frame signal is reversely switched over and kept on for a shorter period of time than half of a cycle of the display frame signal.

When the blue-color display inspection is conducted, the display panel is controlled in the display panel controlling process such that only the light-transmitting section corresponding to the blue color filter is set light-transmissive and the other light-transmitting sections are light-shielded, and controlling in the illumination controlling process such that only the blue illuminating device is turned on.

When the red-color display inspection is conducted, the display panel is controlled in the display panel controlling process such that only the light-transmitting section corresponding to the red color filter is set light-transmissive and the other light-transmitting sections are light-shielded, and controlling in the illumination controlling process such that only the red illuminating device is turned on.

In the above inspection methods, the luminescent spot defects, leakage defects and color defects of the display panel can be detected at high accuracy by controlling the brightness, lighting timing and color of the illuminating device depending on inspection purposes.

BRIEF DESCRIPTION OF THE DRAWINGS

The invention will be described with reference to the accompanying drawings, wherein like numbers reference like elements.

DESCRIPTION OF EXEMPLARY EMBODIMENT(S)

An exemplary embodiment of the invention will be described below with reference to the attached drawings.

Figure 1:
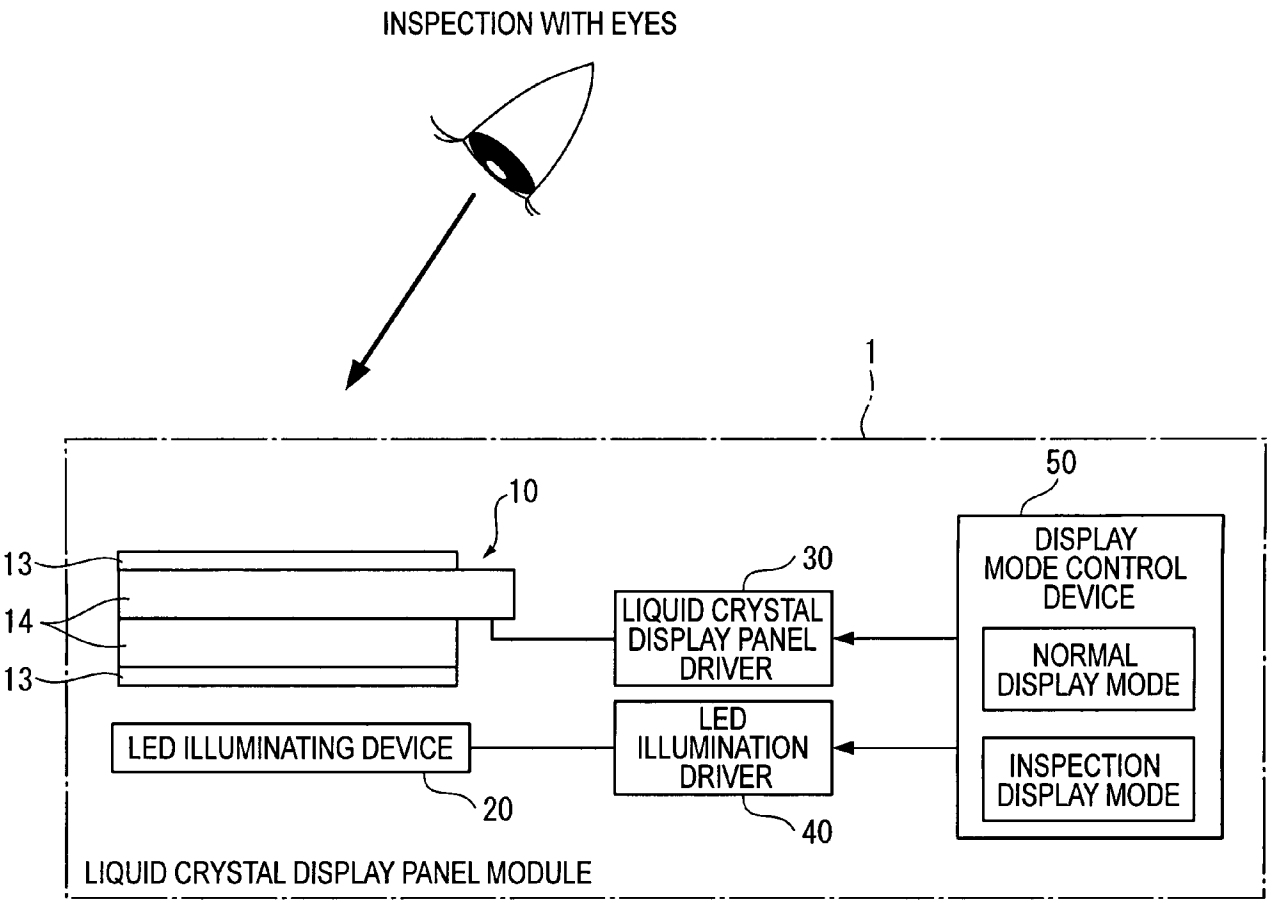
FIG. 1 is a block diagram of a liquid crystal display panel module of an exemplary embodiment according to the invention.

FIG. 1 is a block diagram schematically showing a structure of a liquid crystal display panel module 1 as a display panel module of the exemplary embodiment.

As shown in FIG. 1, the liquid crystal display panel module 1 includes: a liquid crystal panel 10 as a display panel, a LED illuminating device 20 as an illuminating device for irradiating an illumination light to the liquid crystal display panel 10, a liquid crystal display panel driver 30 as a display panel controller for driving the liquid crystal display panel 10, an LED illumination driver 40 as an illumination controller for driving the LED illuminating device 20 and a display mode control device 50 as a display mode controller for controlling display modes of the liquid crystal display panel 10 and the LED illuminating device 20 by switching between a normal display mode and an inspection display mode.

The liquid crystal display panel 10 herein has the number of pixels such as QVGA (320*240) and is used as a display unit for compact electronic devices such as mobile phones and portable terminals, for example. Each pixel is made of three light-transmitting sections (dots), each section being provided with a filter of red (R), green (G) or blue (B). Specifically, the liquid crystal display panel 10 has glass substrates 14 sandwiched by polarization plates 13 respectively disposed at ends in a thickness direction of the liquid crystal display panel 10. The glass substrates 14 sandwich orientation layers therebetween (not shown). Between the orientation layers, liquid crystal is sealed. One orientation layer is provided with a color filter having the above described filters of R, G and B that are arranged in mosaic, in stripes, in triangle or the like by screen printing. The glass substrate 14 has transparent electrodes (not shown) to which the liquid crystal display panel driver 30 is connected.

The liquid crystal display panel 10 described above is switchable between a light transmittable state (on state) and a shield state (off state) by driving the liquid crystal display panel driver 30 to apply a voltage to the transparent electrodes in order to control orientation of the liquid crystal of each dot. In the light transmittable state, a light irradiated by the LED illuminating device 20 is transmittable. In the shield state, the light is shielded. More specifically, turning on dots having a red filter alone generates a red-color display state. Similarly, turning on dots having a green filter alone generates a green-color display state, and turning on dots having a blue filter alone generates a blue-color display state. Tuning on all dots having a red, green or blue filter generates a white-color display state. In contrast, turning off all the dots generates a black-color display state. Further, tuning on all the dots having a red, green or blue filter while adjusting the dots allows a light to transmit therethrough by a predetermined transmission amount (e.g. 50%) and generates an intermediate color (gray) display state. The liquid crystal display panel 10 can provide a color (full-color) displaying by transmissive lights that are initially irradiated as a white illumination light by the LED illuminating device 20 and then transmit through a filter of each color of R, G or B so as to emit the corresponding color.

The LED illuminating device 20 includes light-emitting diodes (LEDs) each having a color of red (R), green (G) or blue (B). The light-emitting diodes are arranged in an appropriate pattern on an upper surface of the LED illuminating device 20. Above the upper surface, lenses, filters or the like (not shown) are arranged for equalizing the illumination lights from the LEDs to irradiate the equalized lights to the liquid crystal display panel 10.

The LED illuminating device 20 can switch each LED of the color of R, G or B to be turned on or off by driving the LED illumination driver 40. The luminance of the LED is also switchable. In other words, turning on only red LEDs irradiates a light having a red luminescent color. Similarly, turning on only green LEDs irradiates a light having a green luminescent color, and turning on only blue LEDs irradiates a light having a blue luminescent color. Further, tuning on all dots having a red, green or blue color generates a light having a white luminescent color.

The display mode control device 50 is made of a processor such as a CPU as well as a storage such as a ROM or a RAM, and is adapted to control the normal display mode for displaying video signals from the outside on the liquid crystal display panel 10 and the inspection display mode for inspecting the liquid crystal display panel 10.

Specifically, the display mode control device 50 displays the video signals from the outside on the liquid crystal display panel 10 when being set to the normal display mode by an external operation. While, the display mode control device 50 performs an inspection in accordance with a preprogrammed inspection procedure when being set to the inspection display mode.

The display mode control device 50 is also used as a controller for controlling the liquid crystal display panel driver 30 and the LED illumination driver 40, and is adapted to output control signals for controlling the liquid crystal display panel driver 30 and the LED illumination driver 40.

The control signals output to the liquid crystal display panel driver 30 include information about which dots of which color are to be turned on among the dots of the liquid crystal display panel driver 30 or about the light transmission amount of the dots to be turned on.

The control signals output to the LED illumination driver 40 include information about which LEDs of which color are to be turned on among the LEDs of the LED illuminating device 20 or about the luminance of the turned-on LEDs. The information are preset and stored in the ROM or RAM of the display mode control device 50.

Inspection Procedure

The inspection procedure of the liquid crystal display panel 10 at a time when the display mode control device 50 is set to the inspection display mode will be described below.

Figure 2:
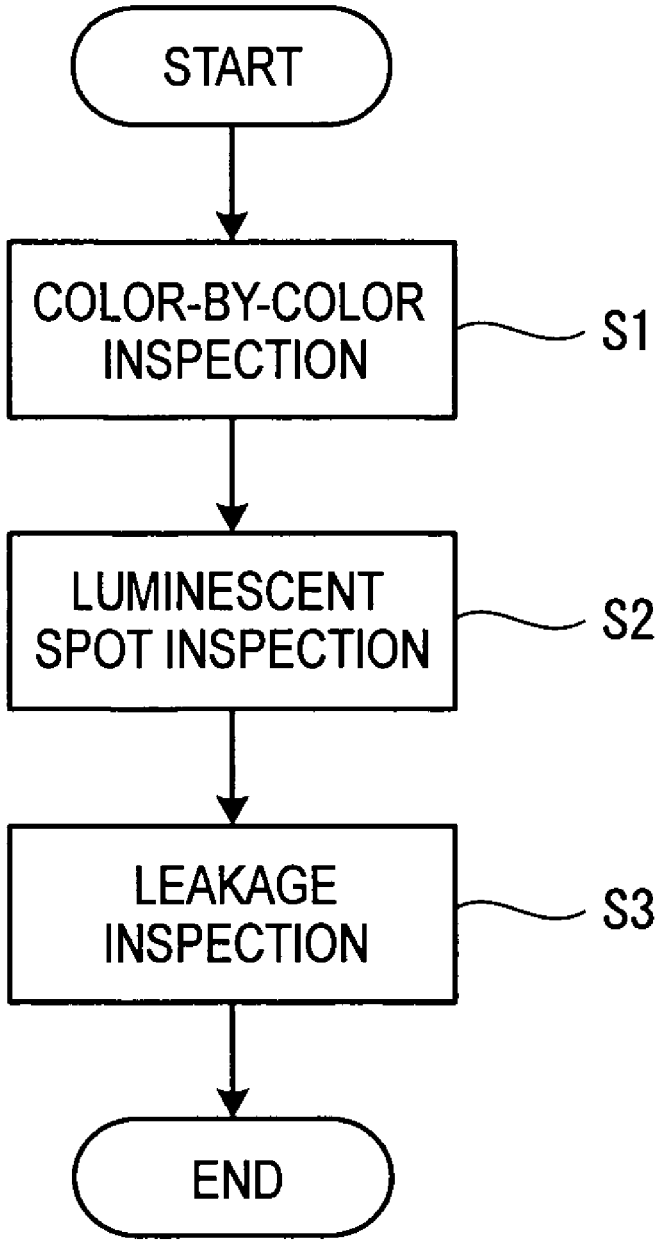
FIG. 2 is a flowchart of an inspection procedure of a liquid crystal display panel.

In the exemplary embodiment, as shown in FIG. 2, the inspection procedure of the liquid crystal display panel 10 includes a single color inspection process (step 1, "step" will be abbreviated hereinafter as "S"), a luminescent spot inspection process S2, a leakage inspection process S3. Defects of the liquid crystal display panel 10 will be inspected for by sequentially executing the processes S1 to S3.

Single Color Inspection Process

Figure 3:
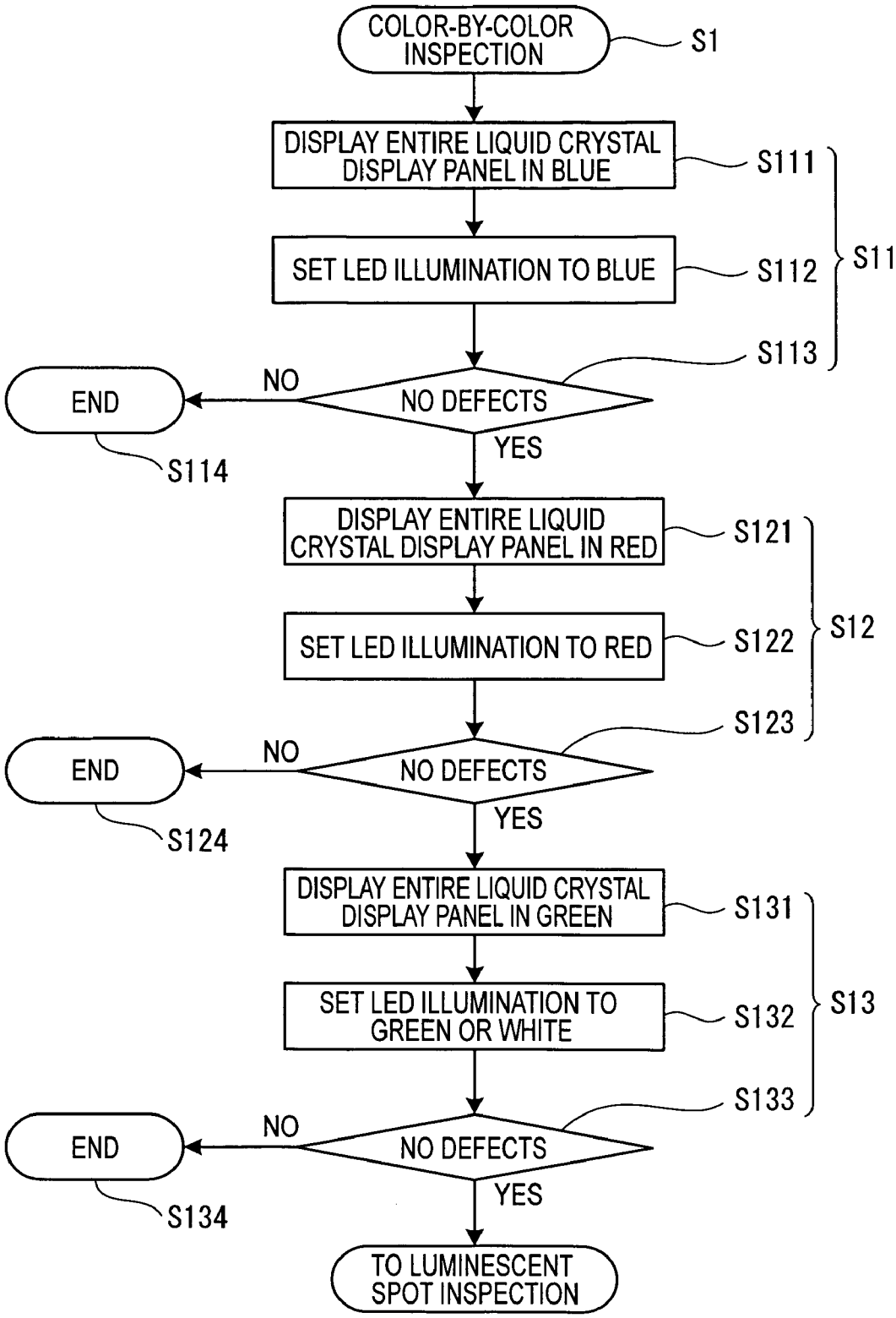
FIG. 3 is a flowchart for illustrating operations in a single color inspection process.

As shown in FIG. 3, the single color inspection process S1 includes a blue color inspection process S11, a red color inspection process S12 and a green color inspection process S13.

In the blue-inspection process S11, firstly, the liquid crystal display panel 10 is driven by the liquid crystal display panel driver 30, thereby placing only dots having a blue filter among the dots of the liquid crystal display panel 10 in the turned-on state in which lights are transmissible (S111). Herein, the dots having a red or green filter are in the turned-off state in which lights are shielded.

Next, the LED illuminating device 20 is driven by the LED illumination driver 40, thereby only the blue LEDs of the LED illuminating device 20 are turned on at a predetermined luminance (S112).

The blue lights irradiated by the LED illuminating device 20 then transmit through the dots having a blue filter in the turned-on state. The transmissive lights that have thus transmitted through the liquid crystal display panel 10 are visually inspected by a checker to judge whether there is a defect or not (S113). When a defect is detected, the inspection of the liquid crystal display panel 10 under inspection is aborted, and such liquid crystal display panel 10 is handled as a defective product (S114). When the liquid crystal display panel 10 is judged to have no defects in S113, such liquid crystal display panel 10 is subject to a subsequent process i.e. the red color inspection process S12.

The red color inspection process S12 is similar to the above blue color inspection process S11. Firstly, dots having a red filter of the liquid crystal display panel 10 are placed in the turned-on state by the liquid crystal display panel driver 30 (S121). Next, only the red LEDs of the LED illuminating device 20 are turned on at a predetermined luminance by the LED illumination driver 40 (S122).

Then, the transmissive lights that have transmitted through the liquid crystal display panel 10 are visually inspected by the checker to judge whether there is a defect or not (S123). When a defect is detected, the inspection of the liquid crystal display panel 10 under inspection is aborted (S124). When the liquid crystal display panel 10 is judged to have no defects, such liquid crystal display panel 10 is subject to a subsequent process i.e. the green color inspection process S13.

The green color inspection process S13 is similar to the above inspection processes S11, S12. Firstly, dots having a green filter of the liquid crystal display panel 10 are placed in the turned-on state by the liquid crystal display panel driver 30 (S131). Next, only the green LEDs of the LED illuminating device 20 are turned on at a predetermined luminance by the LED illumination driver 40, or all of the LEDs of blue, red and green are turned on at a predetermined luminance to irradiate a white light (S132).

Then, the transmissive lights that have transmitted through the liquid crystal display panel 10 are visually inspected by the checker to judge whether there is a defect or not (S133). When a defect is detected, the inspection of the liquid crystal display panel 10 under inspection is aborted (S134). When the liquid crystal display panel 10 is judged to have no defects, the single color inspection process S1 ends and such liquid crystal display panel 10 is subject to a subsequent process i.e. luminescent spot inspection process S2.

Luminescent Spot Inspection Process

Figure 4:
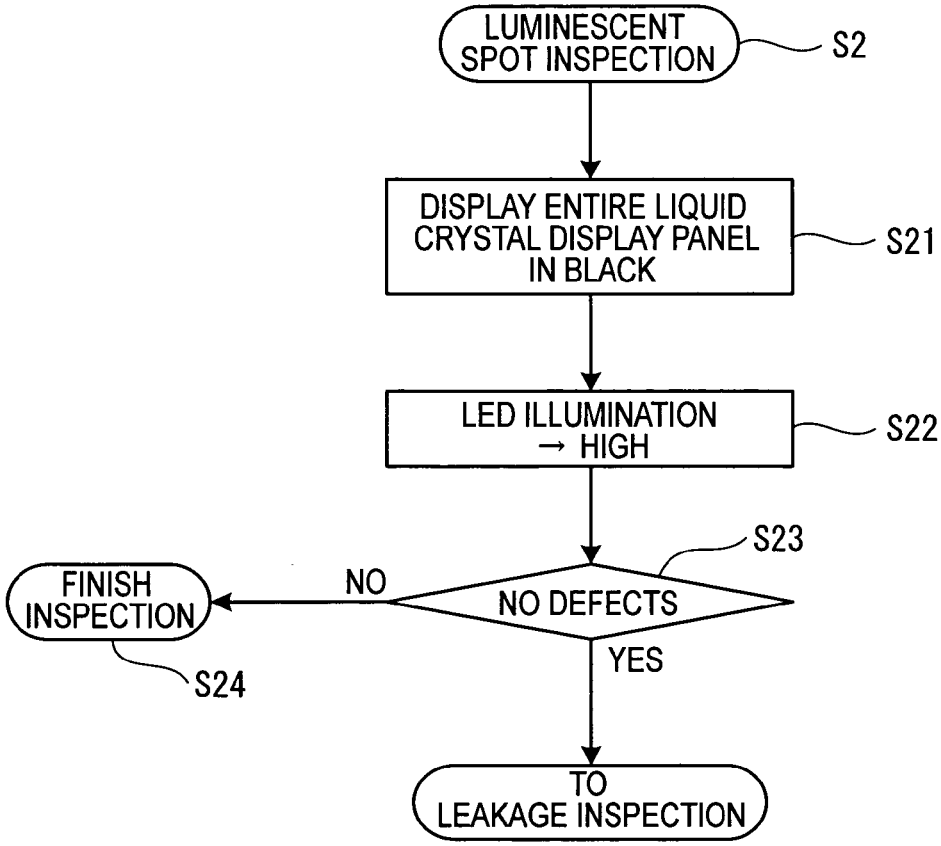
FIG. 4 is a flowchart for illustrating operations in a luminescent spot defect inspection process.

In the luminescent spot inspection process S2, as shown in FIG. 4, firstly, all the dots of the liquid crystal display panel 10 are controlled by the liquid crystal display panel driver 30 into the turned-off state i.e. the shield state in which lights are shielded in order to display the entire screen of the liquid crystal display panel 10 in black (S21).

Next, the LED illuminating device 20 is driven by the LED illumination driver 40, thereby all of the LEDs of blue, red and green of the LED illuminating device 20 are turned on at a high luminance, e.g. at a maximum settable luminance (S22).

The white light irradiated by the LED illuminating device 20 should be shielded by normal dots. However, if a luminescent spot defect exists in the liquid crystal display panel 10, the white light transmits through the defect, generating a luminescent spot on the liquid crystal display panel 10.

Hence, the checker judges whether there is a defect or not by visually inspecting the liquid crystal display panel 10 (S23). If a defect is detected, the inspection of the liquid crystal display panel 10 under inspection is aborted, and such liquid crystal display panel 10 is handled as a defective product (S24). While, when the liquid crystal display panel 10 is judged to have no defects, such liquid crystal display panel 10 is subject to a subsequent process i.e. the leakage inspection process S3.

Leakage Inspection Process

Figure 5:
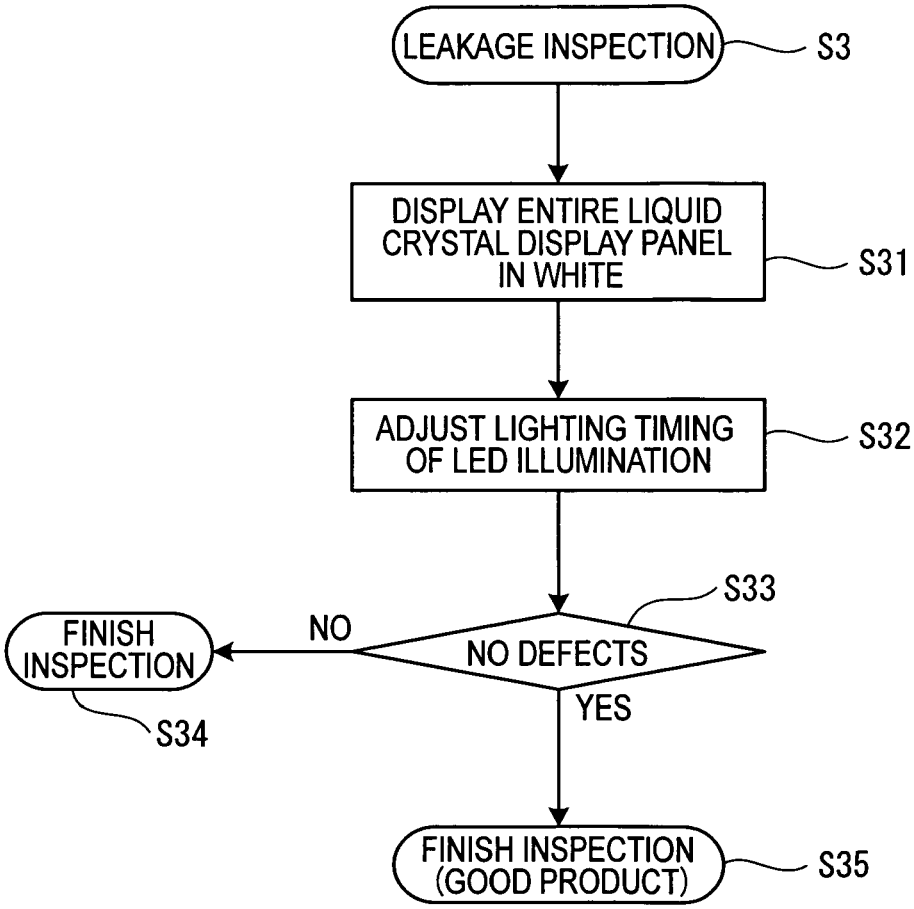
FIG. 5 is a flowchart for illustrating operations in a leakage defect inspection process.

In the leakage inspection process S3, as shown in FIG. 5, firstly, all the dots of the liquid crystal display panel 10 are controlled by the liquid crystal display panel driver 30 into the turned-on state i.e. the light transmittable state in which lights are transmissible in order to display the entire screen of the liquid crystal display panel 10 in white (S31).

Next, the LED illuminating device 20 is driven by the LED illumination driver 40, thereby all of the LEDs of blue, red and green of the LED illuminating device 20 are intermittently turned on at a predetermined interval (S32).

Figure 6:
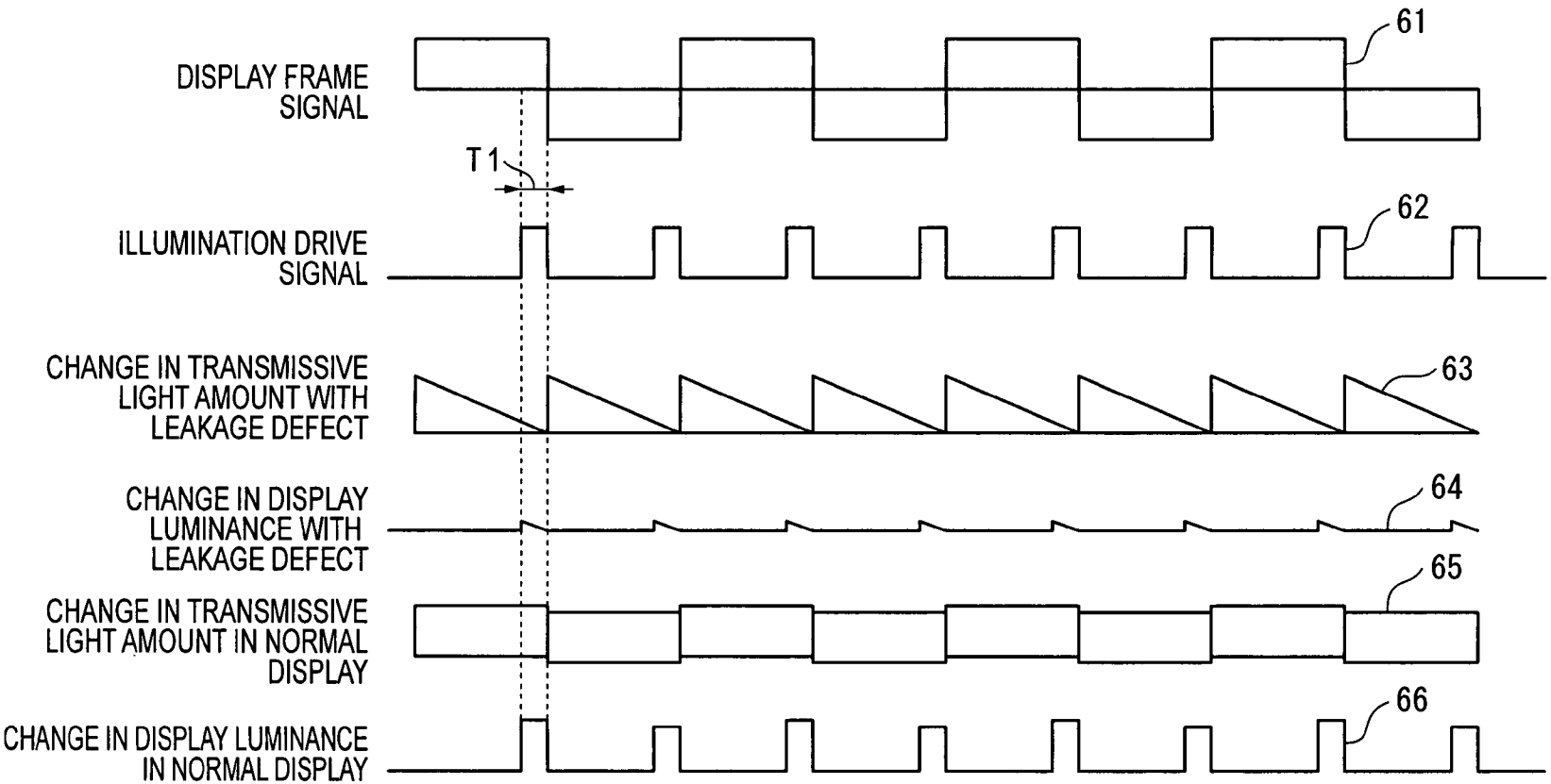
FIG. 6 is a graph showing a display frame signal, an illumination drive signal, transmissive light amount change and display luminance change in the leakage defect inspection process.
Figure 7:
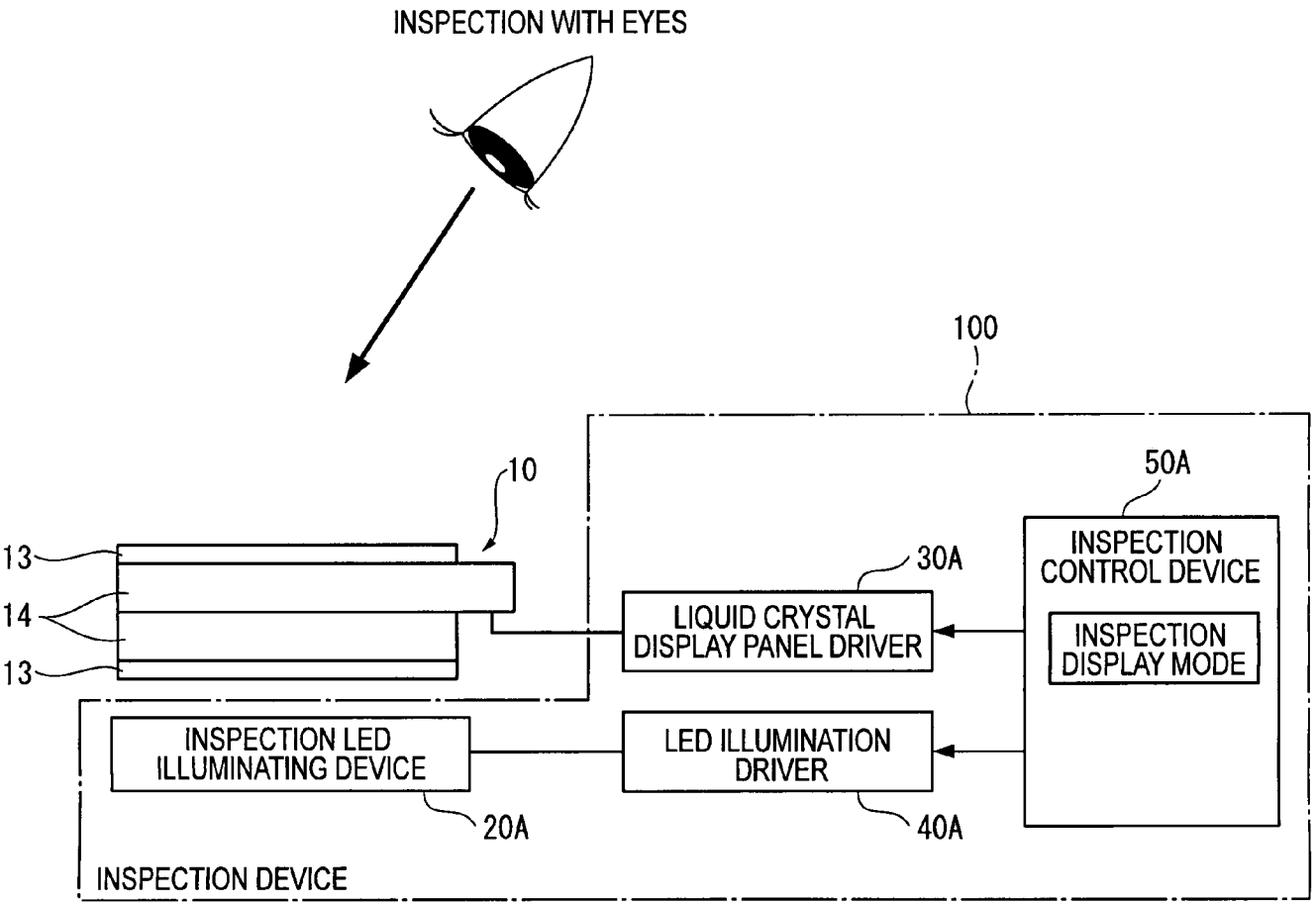
FIG. 7 is a block diagram of an inspection device for a display panel of a modification according to the invention.

Specifically, as shown in FIG. 6, the LED illumination driver 40 is controlled to output an illumination drive signal 62 at a time point just before a pulse switching timing of the display frame signal (liquid crystal display panel drive signal) 61, which is a wave pulse of alternating current. In other words, the illumination drive signal 62 is a signal having a pulse width of a time T1 between the time point just before the pulse switching timing of the display frame signal 61 and the pulse switching timing. Note that, a timing to turn off according to the illumination drive signal 62 may not be simultaneous with the pulse switching timing but before the timing.

Herein, when the pulse of the display frame signal 61 is switched over, a voltage is charged to a predetermined amount, increasing the transmissive light amount 63 of the dots to a predetermined amount. However, if the liquid crystal cell (dot) has a leakage defect, the applied voltage will gradually decrease. Accordingly, the transmissive light amount 63 of the cell will also decrease. The voltage is charged again at the subsequent switching-over of the pulse of the display frame signal 61. Hence, the transmissive light amount becomes minimum at a time point just before the switching-over of the pulse of the display frame signal 61.

Therefore, driving the LED illuminating device 20 by inputting the illumination drive signal 62 in line with the timing makes a display luminance 64 of the dot with a leakage defect very small.

On the other hand, the transmissive light amount 65 of normal dots is maintained substantially constant, though the transmissive light amount 65 may somewhat fluctuate due to the polarity of the display frame signal. Accordingly, the display luminance 66 will be high.

Thus, the checker can easily judge whether or not a leakage defect exists by inspecting whether there is a relatively dark portion as compared to normal dots surrounding the portion (S33).

Note that, in the leakage inspection process S3, the display frame signal 61 is arranged to have a display frame cycle (of 30 to 150 ms, e.g.) which is more than twice of that (of 10 to 16 ms, e.g.) in a normal image display or a normal inspection, and the transmissive light amount 63 of the dot having a leakage defect is arranged to decrease to a certain low level before a subsequent voltage charge, allowing the checker to easily recognize that the luminance 64 is low when the LED illumination driver 40 is turned on.

In S33, when any defect is detected in a dot, the entire inspection procedure is ended and the liquid crystal display panel 10 is handled as a rejected product (S34). While, when no defects is detected in all the inspection processes described above, the liquid crystal display panel 10 is judged to be a good product, finishing the inspection (S35).

Note that, any other inspection may be optionally conducted. For example, various patterns such as a checkered pattern may be displayed on the liquid crystal display panel 10 for defect inspection. Depending on inspection types, only one or two out of the single color inspection process S1, the luminescent spot inspection process S2 and the leakage inspection process S3 may be conducted in place of doing all the processes.

The above described exemplary embodiment has the following advantages.

1. In the single color inspection process S1, turning on blue dots or red dots makes the LEDs of the LED illuminating device 20 having the corresponding colors on to emit a light incident on the liquid crystal display panel 10. Hence, a defect in the blue or red dots can be detected at high accuracy without being effected by leaked lights such as green lights.

Specifically, when the liquid crystal display panel 10 is irradiated by the LED illuminating device 20 with a white light, leaked lights of green color may be generated via the green filter, even where only the dots of blue or red color are turned on. Human eyes are more sensitive to green lights and less sensitive to blue and red lights. Hence, if green leaked lights are generated in the defect inspection on blue or red lights, a defect to be detected may be overlooked.

However, in the exemplary embodiment, the LED illuminating device 20 are adapted to irradiate to-be-inspected dots with illumination lights of its corresponding color such as blue or red. Thereby, the leaked lights of green can be eliminated, so that the checker can detect defects easily and accurately in the visual inspection.

2. In the luminescent spot inspection process S2, the luminance of the illumination lights by the LED illuminating device 20 are controlled to be higher than the luminance in other inspections. Hence, the luminance of a luminescent spot defect becomes high, so that the checker can detect defects easily and accurately in the visual inspection.

3. In the leakage inspection process S3, the emission timing of the LED illuminating device 20 is controlled so as to be just before the pulse switching of the display frame signal 61. Hence, a difference in the luminance between a normal dot and a leakage defect dot can be large and distinguishable. Thereby, the checker can detect defects easily and accurately in the visual inspection.

4. Since LEDs of red, green and blue color are employed as a light source device, it is only necessary to selectively switch the LEDs of a desired color to irradiate each of the plurality of colors. Hence, the luminescent color and the luminance can be easily changed, and the LEDs, which have fast response speeds, enable the luminescent color to be speedy changed, thereby reducing time required for the inspection.

5. In the exemplary embodiment, the above described inspections can be conducted with the liquid crystal display panel driver 30, the LED illumination driver 40 and the display mode control device 50 that are incorporated in the liquid crystal display panel module 1. Hence, the inspection can be conducted not only by manufacturers that produce and sell the liquid crystal display panel module 1, but also by manufacturers that purchase the liquid crystal display panel modules 1 and embed the modules 1 in their products.

6. The liquid crystal display panel driver 30 and the LED illumination driver 40 are controlled by the display mode control device 50 which may be a CPU or a program. Hence, the program and various setting values can be easily updated, and the liquid crystal display panel 10 can be appropriately inspected in the most suitable manner depending on its types or sizes.

It is to be appreciated that the scope of the invention is not limited to the exemplary embodiment, but includes various improvements and modifications described below as long as an object of the present invention can be achieved.

For example, although the invention is utilized in the inspection of the liquid crystal display panel module 1 incorporating the liquid crystal display panel 10, the LED illuminating device (backlight) 20, the liquid crystal display panel driver 30, the LED illumination driver 40 and the display mode control device 50 in the exemplary embodiment, the invention may be utilized in an inspection conducted on the manufacturing line of the liquid crystal display panel 10. Specifically, when the liquid crystal display panel 10 receives a defect inspection before the backlight and the like are incorporated, it is only necessary to set the liquid crystal display panel 10 to an inspection device 100 provided with an inspection LED illuminating device 20A, an inspection liquid crystal display panel driver 30A, an inspection LED illumination driver 40A and an inspection control device 50A, for conducting an inspection similar to the exemplary embodiment.

By thus conducting a defect inspection for the liquid crystal display panel 10 alone, a defected product can be detected before embedding an IC for driving or the backlight, thereby enhancing the yield rate on the manufacturing line of the liquid crystal display panel module 1.

Alternatively, an inspection similar to the exemplary embodiment may be conducted for a display unit such as a projector with the liquid crystal display panel 10 by embedding the LED illuminating device 20, the liquid crystal display panel driver 30, the LED illumination driver 40 and the display mode control device 50 in the display unit beforehand.

In the exemplary embodiment, all of the single color inspection process S1, the luminescent spot inspection process S2 and the leakage inspection process S3 are conducted. However, it is not essential to conduct all these processes, but at least one of the processes may be chosen depending on the inspection purpose.

The order in which the processes are conducted is not limited to the order of the exemplary embodiment. For example, the leakage inspection process S3 may be conducted first.

Further, any other inspections other than the above processes may be conducted depending on the inspection purpose.

In the leakage inspection process S3, although the cycle of the display frame signal is set longer than the cycle for a normal image display or other inspections, the inspection may be conducted at the normal cycle. However, it is preferable to set the cycle longer as described in the exemplary embodiment such that the decrease in luminance of the defect portion at a time when the LED illumination driver 40 is turned off becomes more distinguishable for the checker.

In the exemplary embodiment, the invention is explained using an example in which the liquid crystal display panel 10 is a compact electronic device. However, the invention is not limited thereto and can also be applied to an inspection of a liquid crystal display panel that is used as a display unit for a variety of electronics devices. For example, the invention may be utilized for an inspection of a liquid crystal monitor for personal computers, which has a display size of a larger number of pixels than QVGA. The invention may also be utilized for an inspection of a display unit which has a smaller display size of a smaller number of pixels than QVGA.

In the exemplary embodiment, the liquid crystal display panel 10 is provided with the color filter having the filters of R, G and B. However, the color filter is not limited thereto and may have only two desired filters or four or more filters.

In the exemplary embodiment, the LED illuminating device 20 having the light-emitting diodes as the light source device is used. However, the arrangement is not limited thereto, but the light source device may be adapted to irradiate a plurality of lights by using in combination a light source such as halogen lamps and a color filter, or to have a light-emitting element such as organic electro-luminescence elements (organic EL elements) and plasma elements. Further, the luminescent colors of the light-emitting element are not limited to the three colors of R, G and B, but desired luminescent colors may be selected as long as the luminescent colors are in correspondence with the dot colors (filter colors) of the liquid crystal display panel 10.

In a case in which the single color display inspection is not conducted, the LED illuminating device 20 and the LED illuminating device 20A may be an illuminating device that irradiates a white light.

In the exemplary embodiment, the display mode control device 50 is a CPU or a program. However, the display mode control device 50 is not limited thereto and may be a predetermined hardware.

In the exemplary embodiment, the checker conducts the visual inspection. However, a CCD camera having a monochrome CCD or a color CCD may be used to capture an image displayed on the screen of the liquid crystal display panel 10, and the inspection may be conducted by processing the captured image data. Even in this arrangement, a difference in luminance between a normal portion and a defected portion becomes large, so that the detection of a defect can be easy and accurate.

The display panel to be inspected by the invention is not limited to the liquid crystal display panel 10, but various types of display panels are applicable as long as the display panels have light-transmitting sections of which transmission amount of lights is controllable.

It should be noted that although the best mode and method for implementing the invention have been disclosed above, the invention is not limited thereto. In other words, while the invention has been mainly illustrated and described on the specific exemplary embodiments, a person skilled in the art can modify the arrangements such as shape, material, quantity and the like of the above-described exemplary embodiments without departing from the technical idea and scope of the invention.

Therefore, the description limiting the shapes, the materials and the like disclosed above is intended to be illustrative for easier understanding but not to limit the invention, hence the invention includes the description using a name of component without a part of or all of the limitation on the shape, the material and the like.

What is claimed is:

1. A display panel module, comprising:

a display panel having a light-transmitting section that controls a transmissive light amount;

an illuminating device that irradiates a light to the display panel;

an illumination controller for controlling the drive of the illuminating device;

a display panel controller for controlling the drive of the display panel; and a display mode controller that controls a normal display mode for displaying an image in accordance with image signals input from the outside and an inspection mode for inspecting the display panel, wherein in the inspection mode, a leakage is inspected by the display panel controller inputting a display frame signal of an alternating current signal to the display panel to place the light-transmitting section of the display panel in a light transmittable state and alter a cycle of the display frame signal to more than twice the cycle of the display frame signal during the normal display mode, and the illumination controller controls the lighting timing of the illuminating device such that the illuminating device is turned on at a time just before the display frame signal is switched to a reverse polarity and is kept lit for a shorter period of time than half of the cycle of the display frame signal.

* * * * *